US011136764B2

(12) United States Patent
Leary

(10) Patent No.: US 11,136,764 B2
(45) Date of Patent: Oct. 5, 2021

(54) BRACKET WITH HORIZONTAL AND VERTICAL SWIVEL CAPABILITIES

(71) Applicant: Vinylast, Inc., Lakewood, NJ (US)

(72) Inventor: Steven J. Leary, Barnegat, NJ (US)

(73) Assignee: VINYLAST, INC., Lakewood, NJ (US)

( * ) Notice: Subject to any disclaimer, the term of this patent is extended or adjusted under 35 U.S.C. 154(b) by 637 days.

(21) Appl. No.: 15/971,497

(22) Filed: May 4, 2018

(65) Prior Publication Data

US 2019/0338531 A1 Nov. 7, 2019

(51) Int. Cl.
*E04F 11/18* (2006.01)

(52) U.S. Cl.
CPC ..... *E04F 11/1834* (2013.01); *E04F 11/1836* (2013.01); *E04F 2011/1821* (2013.01)

(58) Field of Classification Search
CPC ..... E04F 11/1834; E04F 11/1836; E04F 2011/1821; E04F 2011/1827; Y10T 403/7041; Y10T 403/46; Y10T 403/32213; Y10T 403/32221; Y10T 403/32188; Y10T 403/32131; Y10T 403/4694; Y10T 403/7026; E04H 2017/1447; E04H 17/1421; E04H 2017/1491; F16C 11/045; F16B 9/058; F16B 9/052
USPC ..... 256/65.03, 67, 65.07, 65.14
See application file for complete search history.

(56) References Cited

U.S. PATENT DOCUMENTS 3,008,310 A * 11/1961 Bastow ..... A01B 71/08 464/178
3,526,390 A * 9/1970 Horgan, Jr. ..... E04F 11/1836 256/68
3,648,982 A * 3/1972 Sabel ..... E04F 11/1834 256/65.05
5,026,028 A * 6/1991 Ooi ..... E04F 11/1834 248/251
5,626,435 A * 5/1997 Wohlhuter ..... B60D 1/52 280/416.1
5,695,174 A * 12/1997 Tsai ..... E04H 12/2215 256/19
5,842,685 A * 12/1998 Purvis ..... E04G 21/3223 256/67
6,279,880 B1 * 8/2001 Hawks, Jr. ..... E04G 21/3219 256/67
6,931,793 B2 * 8/2005 Joyce ..... E04D 13/0315 182/112
D553,956 S * 10/2007 Jones ..... D8/355

(Continued)

FOREIGN PATENT DOCUMENTS

AU 628196 B2 * 9/1992 ..... E04H 17/1452
CA 2957252 A1 * 8/2018 ..... E04F 11/1842

(Continued)

OTHER PUBLICATIONS

NOH, Description Translation of KR 101663738 B1, Oct. 2016, Patent Translate (Year: 2016).*

(Continued)

*Primary Examiner* — Amber R Anderson
*Assistant Examiner* — Zachary A Hall

(57) ABSTRACT

In one example, a bracket includes a swivel rotatably mounted on a hinge and a keyway separable from the hinge. The swivel includes a key, while the keyway includes a recess. The key and the recess are shaped to allow the swivel and the keyway to connect to each other in a plurality of positions.

18 Claims, 6 Drawing Sheets

(56) References Cited

U.S. PATENT DOCUMENTS

| | | | | |
|---|---|---|---|---|
| 7,500,654 | B2 * | 3/2009 | Rosaen | E04H 12/2215 248/545 |
| 10,047,789 | B1 * | 8/2018 | Mosby | F16C 11/10 |
| 10,407,915 | B2 * | 9/2019 | Hart | E04F 10/005 |
| 10,407,916 | B1 * | 9/2019 | Samad | E04F 11/1834 |
| 10,513,854 | B2 * | 12/2019 | Timmons | E04F 11/1844 |
| 11,000,942 | B1 * | 5/2021 | Meyer | B25G 3/26 |
| 2002/0041791 | A1 * | 4/2002 | Friedrich | F16F 15/124 403/359.1 |
| 2007/0145343 | A1 * | 6/2007 | Lehmann | E04F 11/1817 256/67 |
| 2010/0091494 | A1 * | 4/2010 | Pearson | F21V 33/006 362/249.02 |
| 2010/0176361 | A1 * | 7/2010 | Lehmann | E04F 11/1817 256/67 |
| 2013/0175488 | A1 | 7/2013 | Burt et al. | |
| 2013/0328004 | A1 * | 12/2013 | Truckner | E04H 17/20 256/65.01 |
| 2018/0163765 | A1 * | 6/2018 | Prather, Jr. | F16B 2/065 |

FOREIGN PATENT DOCUMENTS

| | | | | |
|---|---|---|---|---|
| DE | 202008007457 | U1 * | 8/2008 | E04F 11/1834 |
| EP | 2902566 | A2 * | 8/2015 | E04F 11/1834 |
| GB | 2183720 | A * | 6/1987 | E04H 1/1272 |
| KR | 200149503 | Y1 * | 6/1999 | |
| KR | 101302070 | B1 * | 9/2013 | |
| KR | 2088599 | B1 * | 2/2015 | |
| KR | 101490492 | B1 * | 2/2015 | |
| KR | 101663738 | B1 * | 10/2016 | |
| WO | WO-2010037509 | A1 * | 4/2010 | F16C 33/208 |

OTHER PUBLICATIONS

Avalon Installation Instructions, downloaded from http://www rdirail com/homeowner/resources/installation_instructions/ on May 3, 2018, 6 pages.

* cited by examiner

BRACKET WITH HORIZONTAL AND VERTICAL SWIVEL CAPABILITIES

FIELD OF THE INVENTION

The present invention relates generally to railing systems and relates more specifically to hardware used in the installation of railing systems.

BACKGROUND OF THE DISCLOSURE

Railing systems are commonly used to provide stability and support to structures such as stairways, landings, and decks. Traditionally, a railing is installed to connect a plurality of posts that are spaced apart along a support surface. At each post, the railing is connected to the post by a bracket.

In some cases, it may be necessary for the railing to be installed on a slope or at an angle in order to connect the posts. FIG. 1A, for example, illustrates a railing 100A that is installed on a slope, to connect a plurality of posts 102A that are mounted along a set of stairs. FIG. 1B illustrates a railing 100B that is installed at an angle, to connect a plurality of posts 102B that meet at a corner of a deck. When the railing is installed on a slope or at an angle, the brackets that are used connect the railing to the posts typically swivel to accommodate the angles at which the railing and the posts meet.

SUMMARY OF THE INVENTION

In one example, a bracket includes a swivel rotatably mounted on a hinge and a keyway separable from the hinge. The swivel includes a key, while the keyway includes a recess. The key and the recess are shaped to allow the swivel and the keyway to connect to each other in a plurality of positions In another example, a bracket for mounting a railing to a post includes a hinge support to mount to the post, a swivel rotatably mounted to the hinge support, and a keyway to mount to the railing. The hinge support includes a body including a bay and a hinge bolt supported within the bay. The swivel includes a barrel including an axial bore through which the hinge bolt passes and a key connected to the barrel. The keyway includes a recess. A shape of the key and a shape of the recess allow the swivel and the keyway to connect to each other in a plurality of positions while preventing turning of the recess around the key.

BRIEF DESCRIPTION OF THE DRAWING

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one example, the present disclosure provides a bracket with horizontal and vertical swivel capabilities. As discussed above, in some railing system applications, it may be necessary for the railing to be installed on a slope or at an angle in order to connect the posts. When the railing is installed on a slope or at an angle, the brackets that are used connect the railing to the posts typically swivel to accommodate the angles at which the railing and the posts meet. For instance, a bracket with vertical swivel capabilities could be used to adjust the angle at which a railing mounted along stairs meets a post; a bracket with horizontal swivel capabilities could be used to adjust the angle at which a railing mounted near a corner of a deck meets a post.

Conventionally, brackets with vertical swivel capabilities have different configurations than brackets with horizontal swivel capabilities. Thus, when installing a railing system, the person performing the installation must have two different types of brackets handy in order to accommodate sloped and angled railing installations. The need to keep multiple different types of brackets on hand can be expensive, and can also increase the amount of time it takes to install the railing system (e.g., if any modifications are made to the design of the railing system).

Examples of the present disclosure provide a bracket having both vertical and horizontal swivel capabilities. In one example, the bracket includes two separable pieces that can be connected in a plurality of (i.e., at least two) different positions, where a first position of the plurality of positions provides vertical swivel capabilities, and a second position of the plurality of positions provides horizontal swivel capabilities. The bracket may be formed of a sturdy material such as a metal, a die cast metal, a polymer, or a polymer-based substance such as vinyl.

Figure 1A:
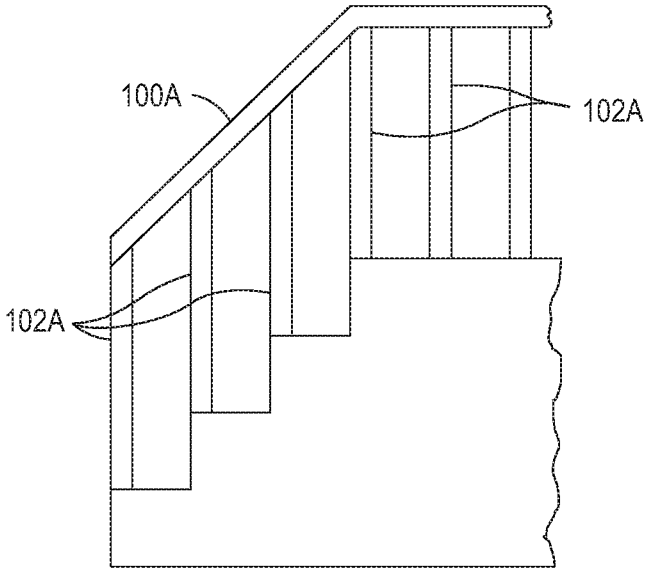
FIG. 1A illustrates a railing that is installed on a slope, to connect a plurality of posts that are mounted along a set of stairs.
Figure 1B:
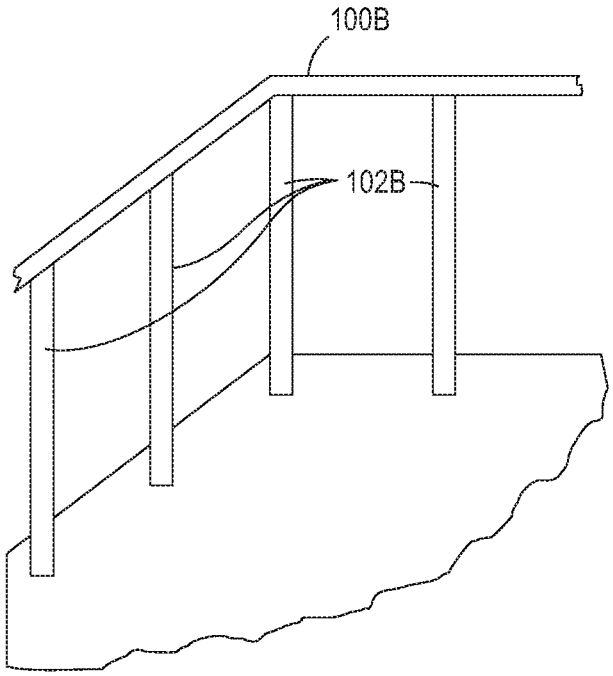
FIG. 1B illustrates a railing that is installed at an angle, to connect a plurality of posts that meet at a corner of a deck.
Figure 2:
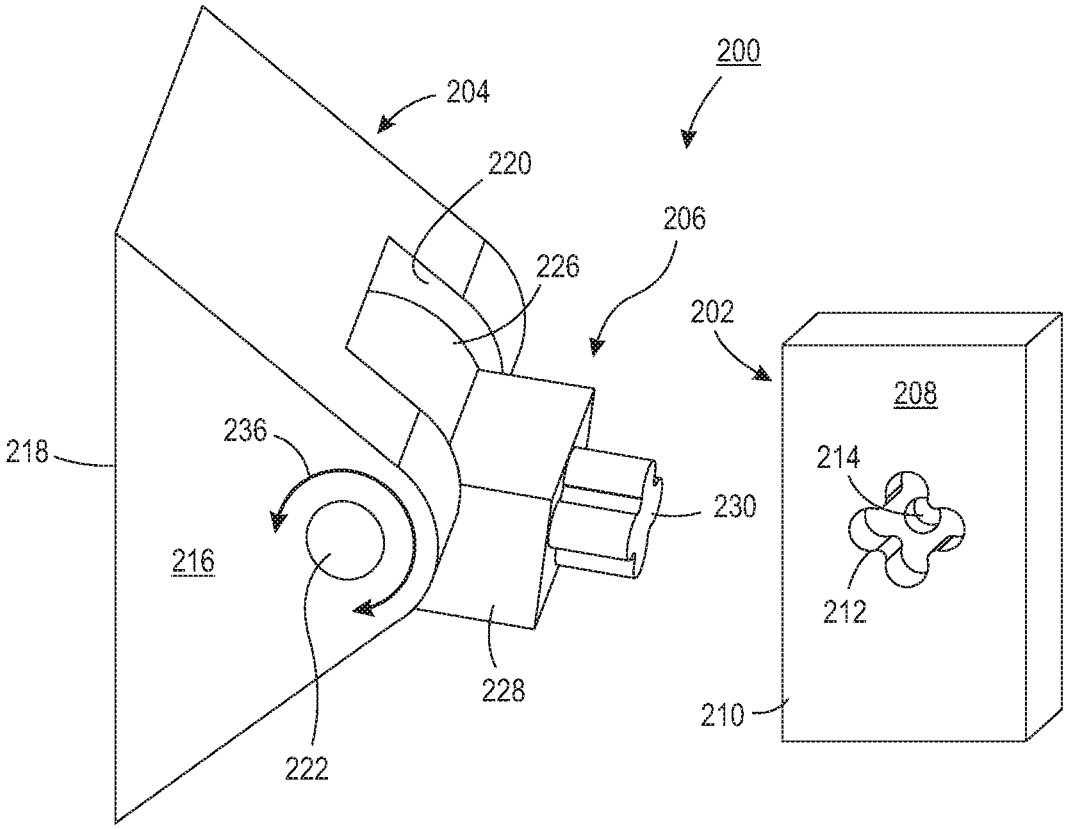
FIG. 2 illustrates one example of a bracket according to the present disclosure that has both vertical and horizontal swivel capabilities.

FIG. 2 illustrates one example of a bracket 200 according to the present disclosure that has both vertical and horizontal swivel capabilities. In one example, the bracket 200 includes first, second, and third main components: a keyway 202, a hinge support 204, and a swivel 206.

The keyway 202 may be configured for attachment to a railing. In one example, the keyway 202 comprises a solid block 208. The block 208 may have a generally rectangular structure and may include a plurality of planar surfaces, including a first surface 210 in which a recess 212 is formed. In one example, the recess 212 extends part of the way through the solid mass of the block 208. In another example, the recess 212 extends all of the way through the block 208, e.g., as a through-hole or aperture. In another example still, the recess 212 extends part of the way through the mass of the block 208, where it meets a circular aperture 214 that extends the rest of the way through the mass of the block 208

(e.g., through to a second surface that is positioned opposite the first surface 210, such that the recess 212 is counter bored). The circular aperture 214 may be threaded.

In one example, the recess 212 has a symmetrical shape resembling a cloverleaf or a cross (e.g., such that a four "leaves" are defined). However, in other examples, the recess 212 may have other shapes (e.g., circular, rectangular, triangular, etc.).

Figure 3:
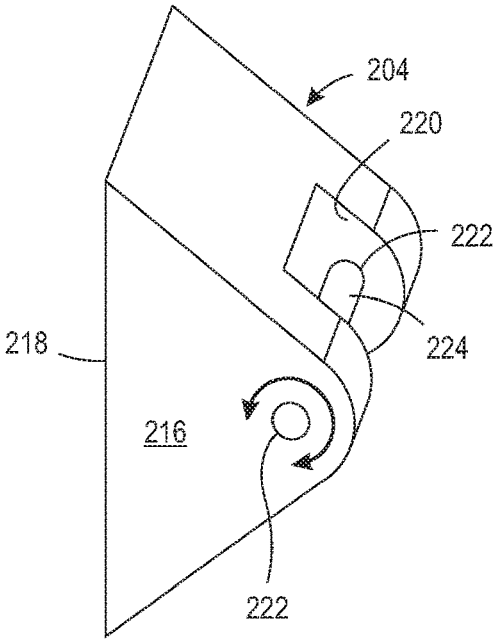
FIG. 3 illustrates the post component of FIG. 2 on its own.

The hinge support 204 may be configured for attachment to a post. In one example, the hinge support 204 includes a body 216 that includes at least one planar surface 218 and a bay 220 defined in a surface opposite the planar surface 218. As more clearly illustrated in FIG. 3, which illustrates the hinge support 204 of FIG. 2 on its own, the bay 220 comprises a hollowed out opening in the body 216. In one example, an aperture 222 is formed on each side of the bay 220, to allow a hinge bolt 224, rod, or similar item to be supported within the bay 220.

The swivel 206 may be configured to connect the keyway 202 to the hinge support 204 in a manner that allows the keyway 202 and the hinge support 204 to swivel or rotate relative to each other. In one example, the swivel 206 includes a barrel 226, a planar extension 228, and a key 230.

Figure 4A:
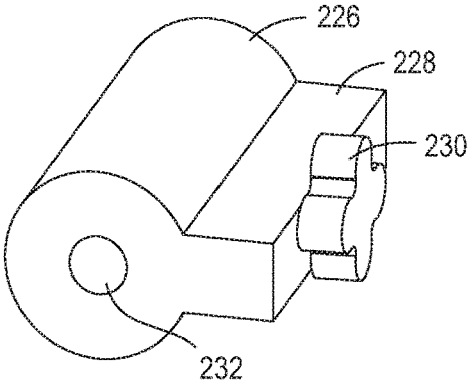
FIGS. 4A and 4B illustrate isometric and front views of the swivel component of FIG. 2, respectively.
Figure 4B:
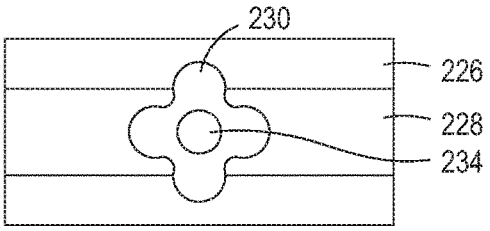

As more clearly illustrated in FIGS. 4A and 4B, which illustrate isometric and front views of the swivel 206 of FIG. 2, respectively, the barrel 226 may be cylindrical in shape, with an axial bore 232 formed through the center of the cylinder.

The planar extension 228 is coupled to the barrel 226 and extends outward from a radial surface of the barrel 226. The key 230 is coupled to a face of the planar extension 228 that is opposite a face by which the planar extension 228 is coupled to the barrel 226 (i.e., such that the planar extension 228 is positioned between the barrel 226 and the key 230). Thus, the key 230 may form a protrusion from the planar extension 228. In one example, the key 230 has a shape that is identical to the shape of the recess 212 in the keyway 202. Thus, the key 230 may have a symmetrical shape resembling a cloverleaf or a cross (e.g., such that a four "leaves" are defined). However, in other examples, the key 230 may have other shapes (e.g., circular, rectangular, triangular, etc.), as long as the other shape is identical to the shape of the recess 212. Furthermore, as illustrated in FIG. 4B, in one example, an aperture 234 is formed in the center of the key 230. The aperture 234 may be threaded.

Referring back to FIG. 2, the bracket 200 is assembled as follows. The swivel 206 is mounted in the bay 220 of the hinge support 204, e.g., by passing the hinge bolt 224 of the hinge support 204 through the axial bore 232 of the swivel 206. This allows the swivel 206 to swivel or rotate about an axis of rotation that is collinear with the hinge bolt 224, as indicated by the arrow 236.

Next, the keyway 202 is connected to the swivel 206 by fitting the key 230 of the swivel 206 into the recess 212 in the keyway 202. The keyway 202 may be secured to the swivel 206 by passing a machine screw or other fastener through the circular aperture 214 in the keyway 202 and the aperture 234 in the key 230. Thus, the keyway 202 is fixedly connected to the swivel 206 (i.e., the keyway 202 and the swivel 206 do not move relative to each other once connected), while the swivel is rotatably connected to the hinge support 204 (i.e., is able to rotate about a single axis of rotation that is collinear to the hinge support's hinge bolt 222). In one example, the key 230 may be fit into the recess 212 in one of at least two different positions. For instance, a first position may provide vertical swivel capabilities, while a second position may provide horizontal swivel capabilities. In one example, there is a ninety degree different between the first position and the second position.

Figure 5A:
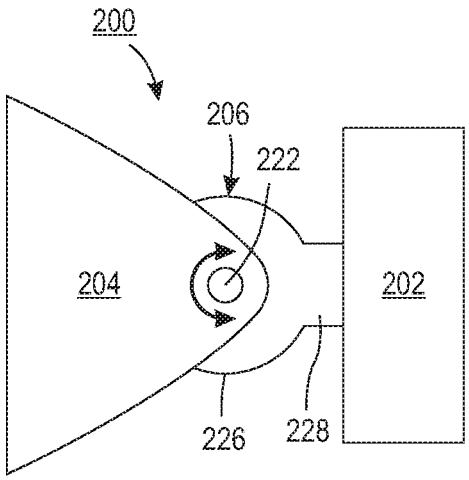
FIGS. 5A and 5B illustrate examples of first and second positions, respectively, at which the swivel component of FIG. 2 may be connected to the railing component of FIG. 2.
Figure 5B:
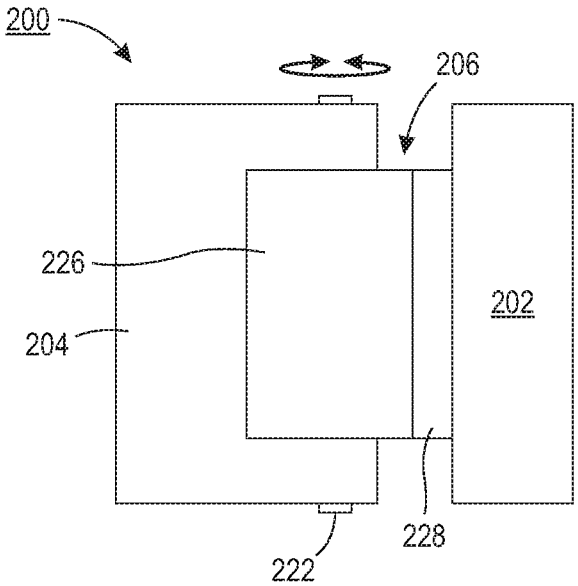

FIGS. 5A and 5B, for instance, illustrate examples of first and second positions, respectively, at which the swivel 206 of FIG. 2 may be connected to the keyway 202 of FIG. 2. In FIG. 5A, the swivel 206 is connected to the keyway 202 such that the axis about which the swivel 206 rotates (as defined by the hinge bolt 222) is oriented in a first direction (i.e., out of the page). However, by turning the hinge support 204 and swivel 206 by ninety degrees (or alternatively by turning the keyway 202 by ninety degrees), the axis about which the swivel 206 rotates is oriented in a second direction (i.e., along the lengthwise dimension of the page) that is substantially perpendicular to the first direction.

The shapes of the key 230 and the recess 212 allow the swivel 206 to connect to the keyway 202 regardless of whether they are fitted together in the first position or the second position. As discussed above, the shapes of the key 230 and the recess 212 are identical and may resemble a cloverleaf, a cross, or another shape. In one example, the shape is any shape that allows the swivel 206 and the keyway 202 to connect in at least two positions. In a further example, the shape may also be a shape that prevents turning or twisting of the recess 212 around the key 230, so that the connection of the swivel 206 to the keyway 202 is secure and stable.

Figure 6:
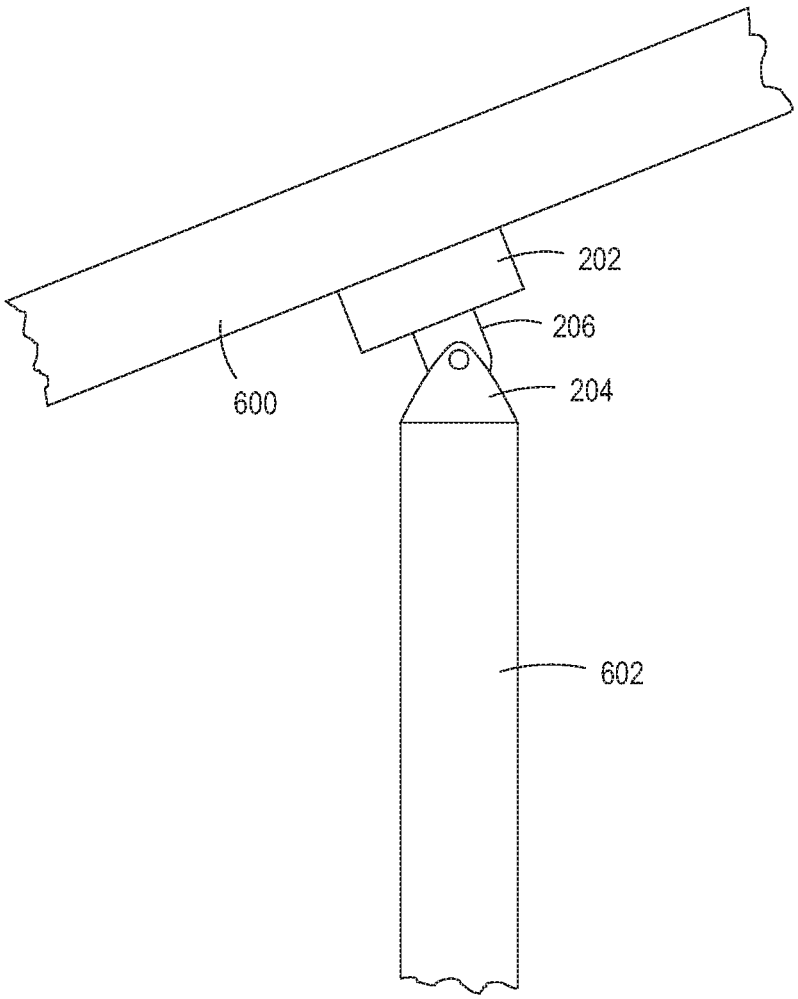
FIG. 6 illustrates an example in which the bracket of FIG. 2 is installed to support a railing that is installed at a slope, such as a railing mounted along a set of stairs.

FIG. 6 illustrates an example in which the bracket 200 of FIG. 2 is installed to support a railing that is installed at a slope, such as a railing mounted along a set of stairs. As illustrated, the keyway 202 of the bracket 200 is mounted to the railing 600, while the hinge support 204 is mounted to the post 602. The swivel 206 connects to the keyway 202 in a first position that provides vertical swivel capabilities, allowing the railing 600 to be installed at any angle relative to the post 602.

Figure 7:
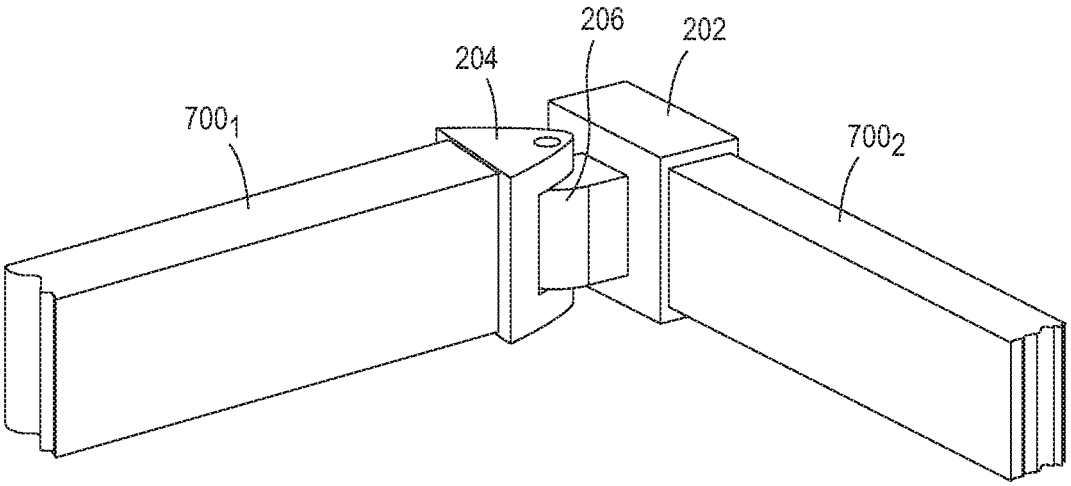
FIG. 7 illustrates an example in which the bracket of FIG. 2 is installed to support two railings that are installed at an angle relative to each other, such as railings that meet at a corner of a deck.

FIG. 7 illustrates an example in which the bracket 200 of FIG. 2 is installed to support two railings $\mathbf{700}_1$ and $\mathbf{700}_2$ that are installed at an angle relative to each other, such as railings that meet at a corner of a deck. As illustrated, the keyway 202 of the bracket 200 is mounted to the first second railing $\mathbf{700}_2$, while the hinge support 204 is mounted to the first railing $\mathbf{700}_1$. The swivel 206 connects to the keyway 202 in a second position that provides horizontal swivel capabilities, allowing the first and second railings $\mathbf{700}_1$ and $\mathbf{700}_2$ to be installed at any angle relative to each other.

Thus, the present invention represents a significant advancement in the field of railing systems. Examples of the present disclosure provide a bracket having both vertical and horizontal swivel capabilities. In one example, the bracket includes two separable pieces that can be connected in at least two different positions, where a first position of the two different positions provides vertical swivel capabilities, and a second position of the two different positions provides horizontal swivel capabilities.

Although various embodiments which incorporate the teachings of the present invention have been shown and described in detail herein, those skilled in the art can readily devise many other varied embodiments that still incorporate these teachings.

What is claimed is:

1. An apparatus, comprising:

a swivel rotatably mounted on a hinge, the swivel including a key, the key including a first threaded aperture formed in the key; and a keyway separable from the swivel and comprising a plurality of planar surfaces, wherein a recess is formed in a first planar surface of the plurality of planar surfaces, wherein the recess extends part of a way through the keyway, and wherein a second threaded aperture extends from the recess and a rest of the way through the keyway to a second planar surface, wherein the key and the recess are shaped to allow the swivel and the keyway to connect to each other in a plurality of positions, and wherein a shape of the key and a shape of the recess have a cross shape.

2. The apparatus of claim 1, wherein the shape of the key is identical to the shape of the recess.

3. The apparatus of claim 2, wherein the shape of the key and the shape of the recess are symmetrical.

4. The apparatus of claim 1, wherein the key and the recess are further shaped to prevent turning of the recess around the key.

5. The apparatus of claim 1, wherein the swivel further comprises:

a barrel having an axial bore; and a planar protrusion extending from a radial surface of the barrel, wherein the key extends from the planar protrusion.

6. The apparatus of claim 5, further comprising:

a hinge support defining a bay; and a hinge bolt supported within the bay, wherein the hinge bolt passes through the axial bore of the barrel.

7. The apparatus of claim 6, wherein the hinge bolt is collinear with an axis of rotation of the swivel.

8. The apparatus of claim 1, wherein the apparatus comprises a bracket for securing a railing.

9. The apparatus of claim 8, wherein the bracket is formed from a metal.

10. The apparatus of claim 8, wherein the bracket is formed from a polymer-based substance.

11. A bracket for mounting a railing to a post, the bracket comprising:

a hinge support to mount to the post, the hinge support comprising:

a body including a bay; and a hinge bolt supported within the bay;

a swivel rotatably mounted to the hinge support, the swivel comprising:

a barrel including an axial bore through which the hinge bolt passes;

a key connected to the barrel; and a first threaded aperture formed in the key; and a keyway to mount to the railing, the keyway comprising:

a block having a plurality of planar surfaces;

a recess extending from a first planar surface of the plurality of planar surfaces and part of a way through a mass of the block; and a threaded counter bore extending from the recess and a rest of the way through the mass of the block to a second planar surface of the plurality of planar surfaces that is opposite the first planar surface, wherein a shape of the key and a shape of the recess allow the swivel and the keyway to connect to each other in a plurality of positions while preventing turning of the recess around the key, and wherein the shape of the key and the shape of the recess have a cross shape.

12. The bracket of claim 11, wherein the shape of the key is identical to the shape of the recess.

13. The bracket of claim 12, wherein the shape of the key and the shape of the recess are symmetrical.

14. The bracket of claim 11, wherein the bracket is formed from a metal.

15. The bracket of claim 11, wherein the bracket is formed from a polymer-based substance.

16. The bracket of claim 11, wherein the hinge bolt is collinear with an axis of rotation of the swivel.

17. An apparatus, comprising:

a swivel rotatably mounted on a hinge, the swivel including a key, the key including a first threaded aperture formed in the key; and a keyway separable from the swivel and comprising a plurality of planar surfaces, wherein a recess is formed in a first planar surface of the plurality of planar surfaces, wherein the recess extends part of a way through the keyway, and wherein a second threaded aperture extends from the recess and a rest of the way through the keyway to a second planar surface, wherein the key and the recess are shaped to allow the swivel and the keyway to connect to each other in a plurality of positions, and wherein a shape of the key and a shape of the recess have a cloverleaf shape.

18. A bracket for mounting a railing to a post, the bracket comprising:

a hinge support to mount to the post, the hinge support comprising:

a body including a bay; and a hinge bolt supported within the bay;

a swivel rotatably mounted to the hinge support, the swivel comprising:

a barrel including an axial bore through which the hinge bolt passes;

a key connected to the barrel; and a first threaded aperture formed in the key; and a keyway to mount to the railing, the keyway comprising:

a block having a plurality of planar surfaces;

a recess extending from a first planar surface of the plurality of planar surfaces and part of a way through a mass of the block; and a threaded counter bore extending from the recess and a rest of the way through the mass of the block to a second planar surface of the plurality of planar surfaces that is opposite the first planar surface, wherein a shape of the key and a shape of the recess allow the swivel and the keyway to connect to each other in a plurality of positions while preventing turning of the recess around the key, and wherein the shape of the key and the shape of the recess have a cloverleaf shape.

* * * * *